US006420642B1

(12) United States Patent
Muramatsu et al.

(10) Patent No.: US 6,420,642 B1
(45) Date of Patent: Jul. 16, 2002

(54) AUTOMATIC PLAYER INCORPORATED IN KEYBOARD MUSICAL INSTRUMENT AND PLUNGER SENSOR FOR DETECTING MOTION OF PLUNGER

(75) Inventors: Shigeru Muramatsu; Tadaharu Kato, both of Shizuoka (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 09/616,653

(22) Filed: Jul. 14, 2000

(30) Foreign Application Priority Data

Jul. 21, 1999 (JP) ..... 11-206163

(51) Int. Cl.[7] ..... G10H 3/06
(52) U.S. Cl. ..... 84/724; 250/227.22; 335/251
(58) Field of Search ..... 84/724; 335/251; 250/227.14, 227.21, 227.22

(56) References Cited

U.S. PATENT DOCUMENTS 4,441,027 A * 4/1984 Richardson et al.
4,790,230 A * 12/1988 Sanderson
5,200,562 A * 4/1993 Kaneko et al.
5,347,124 A * 9/1994 Narukawa et al.
5,909,028 A * 6/1999 Yamamoto ..... 84/724 X

FOREIGN PATENT DOCUMENTS

JP 6-161430 * 6/1994

* cited by examiner

*Primary Examiner*—Jeffrey Donels
(74) *Attorney, Agent, or Firm*—Dickstein, Shapiro, Morin & Oshinsky, LLP.

(57) ABSTRACT

An automatic player is combined with an acoustic piano for selectively moving black/white keys with plungers of solenoid-operated key actuators, and plunger sensors detect current positions of the plungers on trajectories for supplying feedback signals to a controller for exactly controlling the solenoid-operated key actuators, wherein each of the plunger sensors has a reflecting plate fixed to the bottom surface of the plunger and a photo-coupler radiating a light beam to the reflecting plate for producing the feedback signal from the reflection so that the plunger sensor is compact and free from noise and aged-deterioration.

8 Claims, 6 Drawing Sheets

AUTOMATIC PLAYER INCORPORATED IN KEYBOARD MUSICAL INSTRUMENT AND PLUNGER SENSOR FOR DETECTING MOTION OF PLUNGER

FIELD OF THE INVENTION

This invention relates to an automatic playing system for playing a tune on a keyboard musical instrument and, more particularly, to an automatic player appropriate for the keyboard musical instrument and a sensor incorporated in the automatic player for detecting motion of a plunger.

DESCRIPTION OF THE RELATED ART

The automatic player includes a plurality of solenoid-operated key actuators, driver circuits and a controller. The solenoid-operated key actuators are provided under the black/white keys, and include respective solenoids, a yoke and respective plungers. The solenoid is a wire wound on a bobbin, and the wire is connected through the associated driver circuit to the controller. The solenoids are assembled with the yoke, and the associated driver circuits selectively energize the solenoids so as to produce magnetic fields. The plungers are inserted into the bobbins, and are projectable from and retractable into the solenoids. The yoke is mounted on a key bed, and the plungers are arranged in the lateral direction so as to be opposite to lower surfaces of the associated black/white keys.

The automatic player includes plural solenoid-operated key actuators, driver circuits and a controller. The solenoid-operated key actuators are provided under the black/white keys, and include respective solenoids, a yoke and respective plungers. The solenoid is a wire wound on a bobbin, and the wire is connected through the associated driver circuit to the controller. The solenoids are assembled with the yoke, and the associated driver circuits selectively energize the solenoids so as to produce magnetic fields. The plungers are inserted into the bobbins, and are projectable from and retractable into the solenoids. The yoke is mounted on a key bed, and the plungers are arranged in the lateral direction so as to be opposite to lower surfaces of the associated black/white keys.

While the automatic player is performing a tune, the controller selectively instructs the driver circuits to energize the associated solenoids with driving signals, and the energized solenoids cause the associated plungers to push the associated black/white keys, upwardly. The black/white keys are rotated without any fingering, and actuate the associated actions so as to drive the hammers for rotations toward the sets of strings. The hammers strike the associated sets of strings, and generate the piano tones along the tune.

If the magnitude of the driving signals is constant at all times, the associated black/white keys are pushed with constant force, and, accordingly, the hammers strikes the associated sets of strings at constant intensity. The sets of strings generate the piano tones at a constant loudness level, and make the tune flat. In order to vary the force exerted on the black/white keys depending upon the loudness level to be imparted to the piano tones, the driving circuits vary the magnitude of the driving signals through a feedback control. Position sensors or velocity sensors are provided in association with the plungers. The sensor associated with the plunger is hereinbelow referred to as "plunger sensor". The controller checks the feedback signals from the plunger sensors to see whether or not the plungers are moved at target velocities. If the actual velocity is larger or smaller than the target velocity, the controller instructs the associated driver circuit to vary the magnitude of the driving signal. Thus, the plunger sensors are indispensable in the feedback control.

FIG. 1 shows a typical example of the plunger sensor incorporated in a prior art automatic player. Reference numerals 1 and 2 designate the plunger and the solenoid, respectively. The plunger 1 passes through the solenoid 2, and projects from both ends of the solenoid 2. The plunger sensor is implemented by the combination of a gray scale 3 and a photo-interrupter 4. The gray scale 3 is attached to the lower end portion of the plunger 1, and is movable together with the plunger 1. The gray scale 3 is a transparent plate coated with an achromatic color layer. The achromatic color layer is varied in lightness in the direction of the center axis of the plunger 1.

The photo-interrupter 4 is stationary with respect to the solenoid 2, and has a light emitting element and a light detecting element. The light emitting element is opposed to the light detecting element through the gray scale. The light emitting element radiates a light beam toward the gray scale, and the achromatic color layer transmits part of the light beam to the light detecting element. The amount of the incident light on the light detecting element is varied together with the lightness of the achromatic color layer. When the plunger 1 is moved with respect to the solenoid 2, the light beam passes the achromatic color layer at a certain point different from the previous point, and the amount of the incident light is varied. The light detecting element produces the feedback signal representative of the amount of the incident light, and the controller determines the current plunger position on the basis of the feedback signal. The quotient between the length and the lapse of time represents the plunger velocity.

Another prior art plunger sensor directly detects the plunger velocity. The plunger sensor is implemented by the combination of a magnet and a coil. The magnet is attached to the lower end portion of the plunger, and is inserted into the hollow space inside of the coil. The magnet is movable together with the plunger, and the coil is stationary with respect to the solenoid. When the solenoid is energized, the plunger is moved together with the magnet, and the magnet gives rise to electric current flowing the coil. The electromagnetic induction takes place, and the electromotive force is indicative of the velocity of the magnet and, accordingly, the velocity of the plunger.

A problem is encountered in the prior art plunger sensor shown in FIG. 1 in that the manufacturer can not make the solenoid-operated key actuator compact. This is because of the fact that the manufacturer is not permitted to reduce the length of the gray scale 3 below the plunger stroke to be monitored. If the gray scale 3 is shorter than the plunger stroke, the controller can not determine the current position over the monitored range on the basis of the feedback signal. Moreover, the gray scale 3 is to be prolonged in the direction of the plunger stroke, because the manufacturer is to vary the lightness on the achromatic color layer in the direction of the plunger stroke. Thus, the manufacturer can not reduce the prior art solenoid-operated key actuator to a length shorter than the total length of the solenoid 2 and the plunger stroke. The gap between the black/white keys and the key bed is so short that the prior art solenoid-operated key actuators assembled with the plunger sensors are hardly installed in a small-sized acoustic piano. Even though the automatic player is to be installed in a large-sized acoustic piano, the gap between the black/white keys and the key bed sets a limit on the total length of the prior art solenoid-operated key actuators, and the manufacturer can not sufficiently lengthen the solenoid 2. This means that the prior art solenoid-operated key actuators can not exert large force on the black/white keys.

Another problem inherent in the prior art plunger sensor is aged deterioration. The gray scale 3 is not directly connected to the photo-interrupter 4. The gray scale 3 and the photo-interrupter 4 are independently connected to the plunger 1 and another stationary part. The relative relation is liable to be varied during a long time period. When the relative relation is varied from the initial state, the feedback signal does not exactly represent the current plunger position, and the controller can not adjust the force exerted on the black/white key to a target value.

Yet another problem inherent in the prior art plunger sensor is it fails to exactly control the plunger due to noise contained in the feedback signal. The gray scale is varied in the lightness in the direction of the plunger motion, and the ratio between black and white is successively changed on the transparent plate for the lightness. When the light beam is transmitted through the gray scale, a ripple tends to take place in the feedback signal. The controller determines the plunger velocity through the differentiation. However, when the controller differentiates the feedback signal, the ripple causes noise, and the controller fails to exactly grasp the current plunger velocity due to the noise. This results in the failure to move the plunger along the target trajectory.

The prior art plunger sensor of the type having the magnet and the coil has a problem in a small signal-to-noise ratio. While the plunger is moving at a low speed, the electromotive force is small, and the feedback signal is not reliable due to the small signal-to-noise ratio. It is difficult to determine the dead point of the plunger on the basis of the feedback signal from the prior art plunger sensor. It is necessary to form the coil not shorter than the plunger stroke. This results in that the plunger is to downwardly project from the solenoid by the length as long as the plunger stroke. Thus, another problem encountered in the second prior art plunger sensor is same as the first problem inherent in the first prior art plunger sensor shown in FIG. 1.

SUMMARY OF THE INVENTION

It is therefore an important object of the present invention to provide an automatic player, which is installable in a small-sized keyboard musical instrument.

It is also an important object of the present invention to provide a plunger sensor, which is compact and reliable regardless of the plunger speed.

In accordance with one aspect of the present invention, there is provided an automatic player incorporated in a musical instrument for playing a tune on an array of manipulators without a human player comprising solenoid-operated actuators including solenoids respectively creating magnetic fields while driving signals are flowing therethrough and plungers respectively associated with the manipulators of the array and respectively projecting from the solenoids along trajectories for pushing the manipulators, respectively, when the associated solenoids create the magnetic fields, plunger sensors for producing detecting signals respectively representative of current positions of the plungers on the trajectories, each of the plunger sensors including a reflecting means attached to one of the associated plunger and a member stationary with respect to the associated solenoid and a photo-coupler attached to the other of the associated plunger and the member and radiating a light beam toward the reflecting means for producing one of the detecting signals from a reflection returning from the reflecting means, and a controlling system connected to the solenoids and the photo-couplers, determining a magnitude of the driving signals on the basis of the current positions and supplying the driving signals to the solenoids, respectively.

In accordance with another aspect of the present invention, there is provided a plunger sensor associated with a solenoid-operated actuator comprising a reflecting means attached to one of a plunger of the solenoid-operated actuator and a member stationary with respect to a solenoid of the solenoid-operated actuator, and a photo-coupler attached to the other of the plunger and the member and radiating a light beam toward the reflecting means for producing a signal representative of a current plunger position on a trajectory from a reflection returning from the reflecting means.

BRIEF DESCRIPTION OF THE DRAWINGS

The features and advantages of the automatic player and the plunger sensor will be more clearly understood from the following description taken in conjunction with the accompanying drawings in which.

DESCRIPTION OF THE PREFERRED EMBODIMENTS

Figure 1:
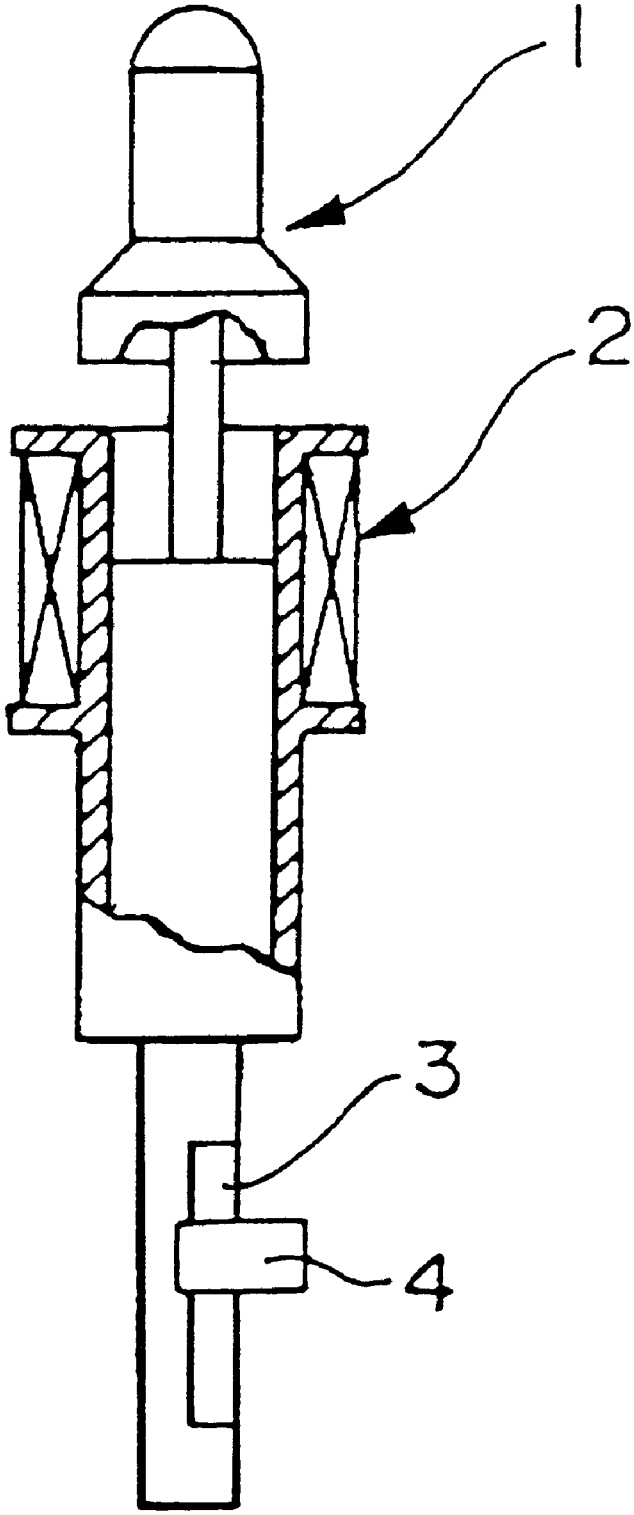
Fig. 1 PRIOR ART
FIG. 1 is a partially cross sectional front view showing the prior art plunger sensor.
Figure 2:
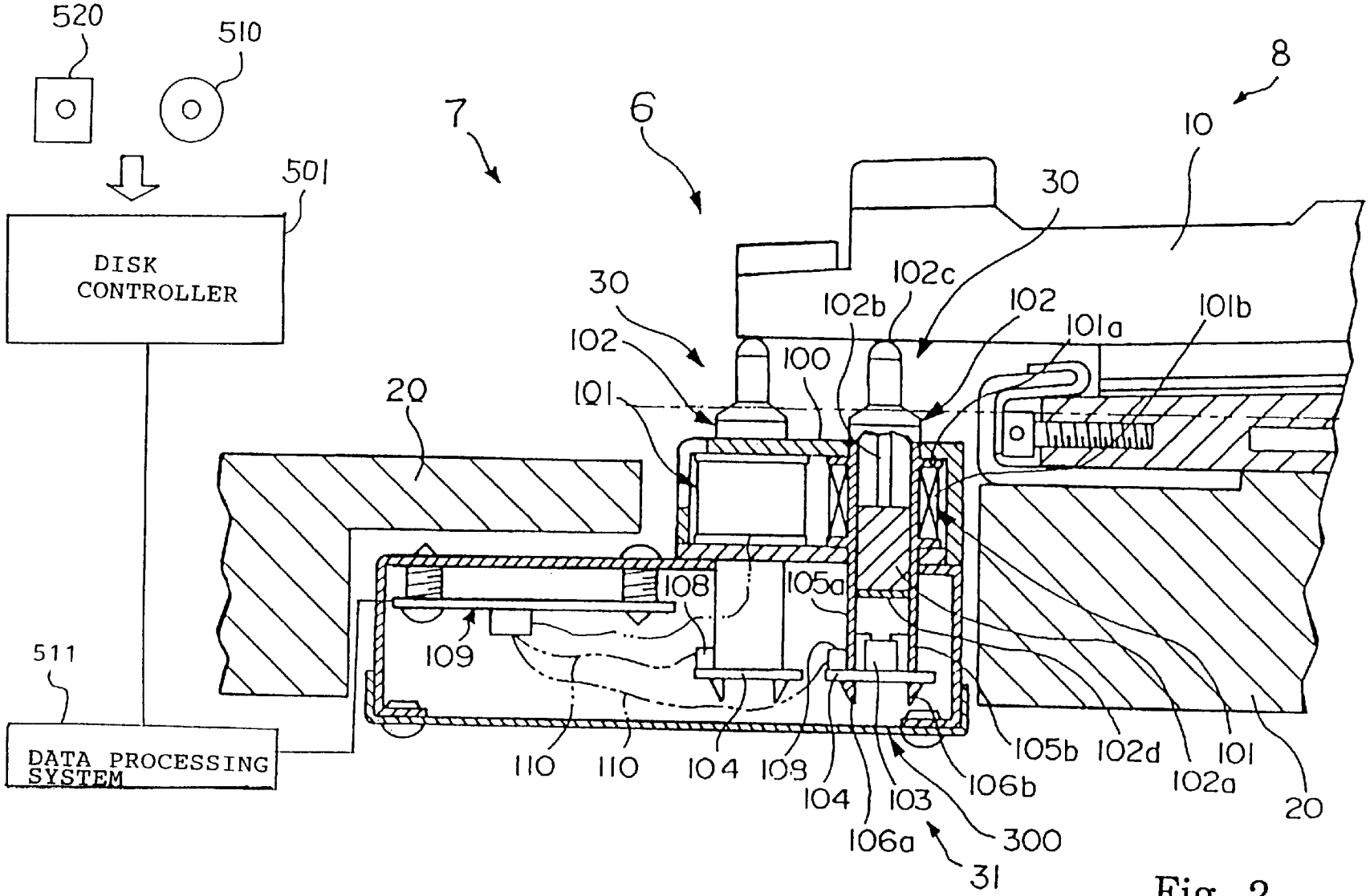
FIG. 2 is a cross sectional side view showing the structure of an automatic player piano according to the present invention.

Referring to FIG. 2 of the drawings, an automatic player piano embodying the present invention largely comprises an acoustic piano 6 and an automatic player 7. In the following description, term "front" modifies a position closer to a player sitting on a chair during a performance than a "rear" position. A direction between the front position and the rear position is modified with term "longitudinal", and "lateral" direction is perpendicular to the longitudinal direction.

The acoustic piano 6 includes a keyboard 8. Black keys and white keys form the keyboard 8, and are laid on the well-known pattern. The black/white key is designated by reference numeral 10. The black/white keys 10 are arranged in parallel in the lateral direction, and extend in the longitudinal direction. The keyboard 8 is mounted on a key bed 20, and the black/white keys 10 are turnable with respect to balance pins (not shown), and the balance pins project from a balance rail over the key bed 20. The key bed 20 forms a part of a piano case together with a side board, an upper beam, a desk board, a top board, etc. These boards and the key bed 20 define a hollow space, and actions, hammers, damper mechanisms and sets of strings are provided in the hollow space. The actions, the hammers, the damper mechanisms and the sets of strings are same as those of a standard acoustic piano, and are well known to skilled person. For this reason, they are not shown in FIG. 2 for the sake of simplicity. The black/white keys 10 are held in contact with the actions through capstan buttons (not shown), and the actions are linked with the associated hammer at a jack (not shown). While the black/white key 10 is sinking, the damper is spaced from the set of strings, and, thereafter, the jack escapes from the associated hammer. The escape gives rise to the rotation of the hammer toward the associated set of strings. The hammer strikes the set of strings, and rebounds thereon. Then, the set of strings vibrates so as to generate the piano tone. Thus, the acoustic piano 6 behaves as similar to the standard acoustic piano.

The automatic player 7 includes solenoid-operated key actuator array 30, plunger sensors 31, an electric circuit 109, a disk controller 501 and a data processing system 511. A disk tray and/or slot is incorporated in the disk controller 501, and a CD-ROM (Compact Disk Read Only Memory) 510 or a floppy disk 520 is loaded on the disk tray or inserted into the slot. A set of music data codes is stored in the CD-ROM 510 and the floppy disk 520. The disk controller 501 reads out the set of music data codes from the CD-ROM 510 or the floppy disk 520, and transfers the set of music data codes to a memory such as a semiconductor random access memory incorporated in the data processing system 511. A central processing unit 512 (see FIG. 6) and a program memory (not shown) are further incorporated in the data processing system 511. The set of music data codes is representative of a tune performed on the keyboard 8 or another keyboard. Control signals are produced from the set of music data codes, and the data processing system 511 sequentially supplies the control data signals to the electric circuit 109. A multiplexer 513 is further incorporated in the data processing system 511, and selectively transfers feedback signals from the plunger sensors 103 to the central processing unit 512.

The electric circuit 109 produces driving signals on the basis of the control data signals, and selectively supplies the driving signals to the solenoid-operated key actuators of the array 30. Then, the solenoid-operated key actuators are energized, and upwardly push the rear portion of the associated black/while keys 10 by means of plungers 102. The plunger sensor 31 detect the current portions of the associated plungers 102, and supply the feedback signals through the multiplexer to the central processing unit 512. The data processing system 511 determines actual trajectories of the plungers 102 on the basis of the feedback signals, and checks target trajectories to see whether or not the plungers 102 are moved on the target trajectories. If a plunger 102 is out of the target trajectory, the data processing system 512 supplies a control data signal to the electric circuit 109 so as to modify the driving signal. Thus, the automatic player 7 faithfully repeats the performance on the basis of the set of music data codes.

The solenoid-operated key actuators 30 and the plunger sensors 31 are described hereinbelow in detail. A hollow space is formed in the key bed 20, and is divided into a front portion and a rear portion. The front portion is open at both ends thereof to the upper hollow space over the key bed 20 and the lower space under the key bed 20. The upper opening of the front portion is laterally elongated under the rear end portions of the black/white keys 10, and is more than twice as wide as the solenoid-operated key actuators 30. The rear portion of the hollow space is open at the lower end thereof to the lower space.

A frame 300 is accommodated in the hollow space, and is supported by the key bed 20. The frame 300 is shaped into a rectangular parallelepiped configuration, and an inner space is defined in the frame 300. An upper opening is formed in the upper plate of the frame 300, and the inner space is open to the upper space over the key bed 20 through the front portion of the hollow space.

The array of solenoid-operated key actuators 30 includes a yoke 100, solenoid units 101 and plungers 102. The yoke 100 is shared between the solenoid units 101, and is laterally elongated. The solenoid units 101 are arranged in a staggering manner, and are supported by the yoke 100. A bobbin 101*a* and a conductive wire 101*b* form each of the solenoid units 101. The bobbin 101*a* has a generally cylindrical shape, and the conductive wire 101*b* is wound on the side surface of the bobbin 101*a*. The conductive wire 101*b* is connected at both ends thereof to the electric circuit 109, and the electric circuit 109 flows the driving current through the conductive wire 101*b*. The driving current signal creates a magnetic field around the conductive coil defined by the wound conductive wire 101*b*. The bobbins 101*a* are covered with the yoke 100, and the yoke 100 offers the magnetic paths to the magnetic fields. The bobbin 101*a* is open at both ends thereof to the outside. The plungers 102 are respectively inserted into the bobbins 101*a*, and are movable in the up-and-down direction. Each of the plungers 102 has a body 102*a*, a rod 102*b* and a plunger head 102*c*. The body 102*a* is accommodated in the deep of the bobbin 101*a*, and the rod 102*b* upwardly projects from the body 102*a* through the upper opening of the bobbin 101*a* over the yoke 100. The plunger head 102*c* is attached to the leading end of the rod 102*b*, and is held in contact with or in proximity with the lower surface of the associated black/white key 10. When the driving current signal creates the magnetic field, the plunger 102 upwardly projects from the bobbin 101*a*, and the plunger head 102*c* pushes the rear end portion of the associated black/white key 10. Thus, the solenoid-operated actuator 30 gives rise to rotation of the associated black/white key 10 without fingering.

The plunger sensors 31 are respectively located under the solenoid-operated key actuators 30, and includes a reflecting plate 102*d*, a set of light-emitting element/light-detecting element 103, a rigid circuit board 104 and a pair of mechanical connectors 105*a*/105*b*. The lower surface of the reflecting plate 102*d* was subjected to a surface treatment such as, for example, a blasting or a frosting, and the reflecting plate 102*d* is attached to the bottom surface of the body 102*a*. The rigid circuit board 104 is fixed to the bobbin 101*a* by means of the pair of connectors 105*a*/105*b*, and the set of light-emitting element/light-detecting element 103 is mounted on the rigid circuit board 104.

Figure 3:
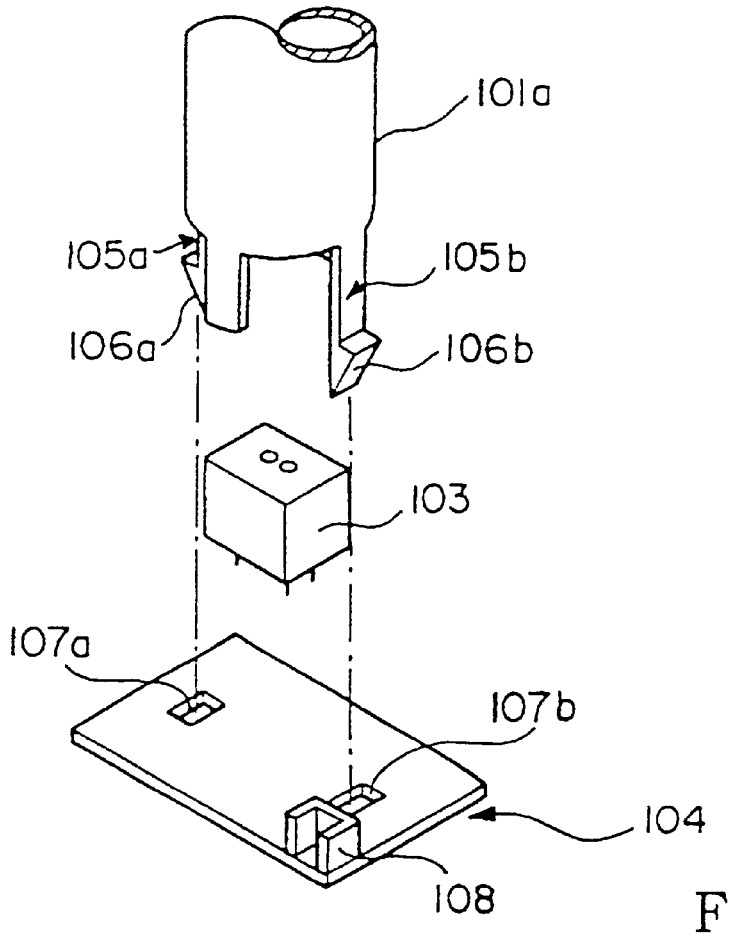
FIG. 3 is a fragmentary perspective view showing a plunger sensor incorporated in the automatic player piano.

The mechanical connectors 105*a*/105*b* downwardly project from the bobbin 101*a* (see FIG. 3), and are integral therewith. The mechanical connector 105*a* is spaced from the other mechanical connector 105*b* at 180 degrees.

Figure 4:
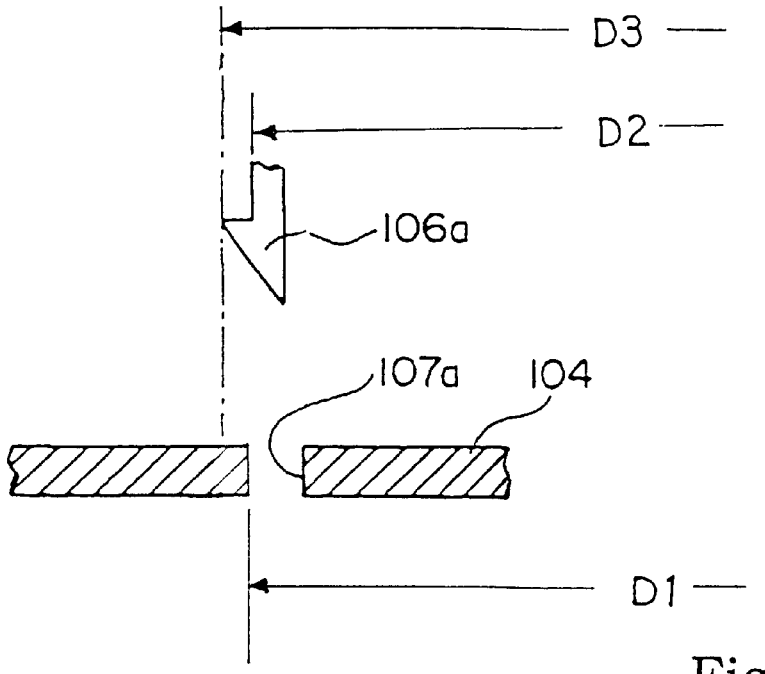
FIG. 4 is a cross sectional view showing the relation between mechanical connectors and a rigid circuit board both forming parts of the plunger sensor.

The mechanical connectors 105*a*/105*b* have wedges 106*a*/106*b*, respectively, and are resiliently deformable. Rectangular holes 107*a*/107*b* are formed in the rigid circuit board 104, and the distance D1 between the inner surfaces of the rectangular holes 107*a* and 107*b* is approximately equal to the distance D2 between the outer surfaces of the stem portions of the mechanical connectors 105*a* and 105*b* as shown in FIG. 4. The distance D3 between the wedges 106*a* and 106*b* is longer than the distances D1 and D2.

When a worker presses the wedges 106*a*/106*b* against the peripheries of the rigid circuit board 104, the mechanical connectors 105*a*/105*b* are inwardly deformed due to the reaction from the rigid circuit board 104, and the wedges 106*a*/106*b* pass the rectangular holes 107*a*/107*b*, and downwardly project from the lower surface of the rigid circuit board 104. The step portions of the mechanical connectors 105*a*/105*b* are held in contact with the inner surfaces of the rigid circuit board 104, and the wedges 106*a*/106*b* prevent the bobbins 101*a* from pulling out from the rigid circuit board 104. Thus, the rigid circuit board 104 is connected to the bobbin 101*a* by means of the mechanical connectors 105*a*/105*b*. In other words, it is unnecessary to prepare a bracket for supporting the rigid circuit board 104. Thus, the mechanical connectors 105*a*/105*b* make the plunger sensors 31 simple.

The mechanical connectors 105*a*/105*b* further achieve the following advantages. First, the assembling work is simplified, because the assembling worker simply presses the rigid circuit board 104 against the wedges 106*a*/106*b*. Second, the plunger sensor 31 is free from the age deterioration, because the connectors 105*a*/105*b* fix the relative relation between the plunger 102 and the set of light-emitting element/light-detecting element to the initial state. Third, the plunger sensor 31 is compact. The manufacturer can make the set of light-emitting element/light-detecting element as thin as possible, because there is not any limit on the dimensions.

Turning back to FIG. 3, though not shown in the figure, a conductive pattern (not shown) is formed on the rigid circuit board 104, and the set of light-emitting element/light-detecting element 103 is connected to the conductive pattern. The set of light emitting element/light detecting element 103 is opposed to the reflecting plate 102*d*. The light emitting element radiates a light beam toward the reflecting plate 102*d*, and the reflection is incident onto the light detecting element.

Figure 5:
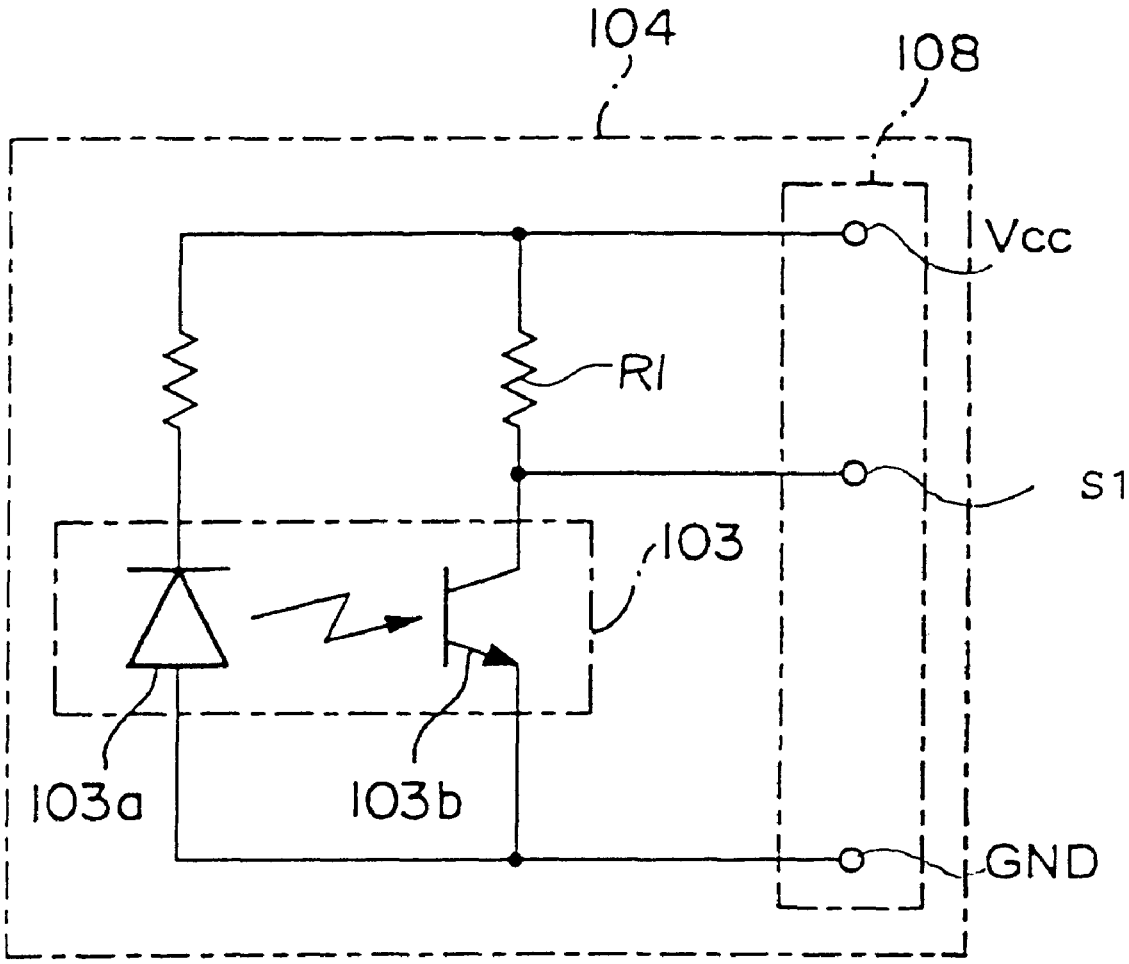
FIG. 5 is a circuit diagram showing the circuit configuration of the plunger sensor.

The conductive pattern is connected to an electric connector 108, and conductive cables 110 are connected between the electric circuit 109 and the electric connector 108. In detail, the electric connector 108 offers a power source terminal Vcc, a ground terminal GND and a signal terminal to the set of light emitting element/light detecting element 103 as shown in FIG. 5. The light emitting element is implemented by a photo-emitting diode 103*a*, and is connected between the power supply terminal Vcc and the ground terminal GND. The potential difference is applied to the light emitting element 103*a* at all times. The light detecting element is implemented by a photo-detecting transistor 103*b*, and is also connected between the power supply terminal Vcc and the ground terminal GND. A resistor R1 is inserted between the power supply terminal Vcc and the collector node of the photo-detecting transistor 103*b*. The amount of photo-current is varied with the intensity of the reflection, and the photo-current is converted to a potential level at the collector node by means of the resistor R1. The collector node is connected to the signal terminal S1, and the potential level is taken out from the signal terminal, and serves as the feedback signal. The conductive cable 110 supplies the power voltage Vcc and the ground voltage to the connector 108, and transfers the feedback signal to the electric circuit 109.

The connector 108 is provided on the rear portion of the rigid circuit board 104. When the plunger sensors 31 are assembled with the solenoid-operated key actuators 30, an assembling worker easily connects the conductive cables 110 to the conductive pattern on the rigid circuit board 104 through the electric connector 108. Similarly, when the plunger sensor 31 is troubled, the conductive cables 110 is easily disconnected from the conductive pattern on the rigid circuit board 104, and the rigid circuit board 104 and the set of light-emitting element/light-detecting element 103 are separated from the bobbin 101*a* by inwardly deforming the mechanical connectors 105*a*/105*b* for the repair.

Figure 6:
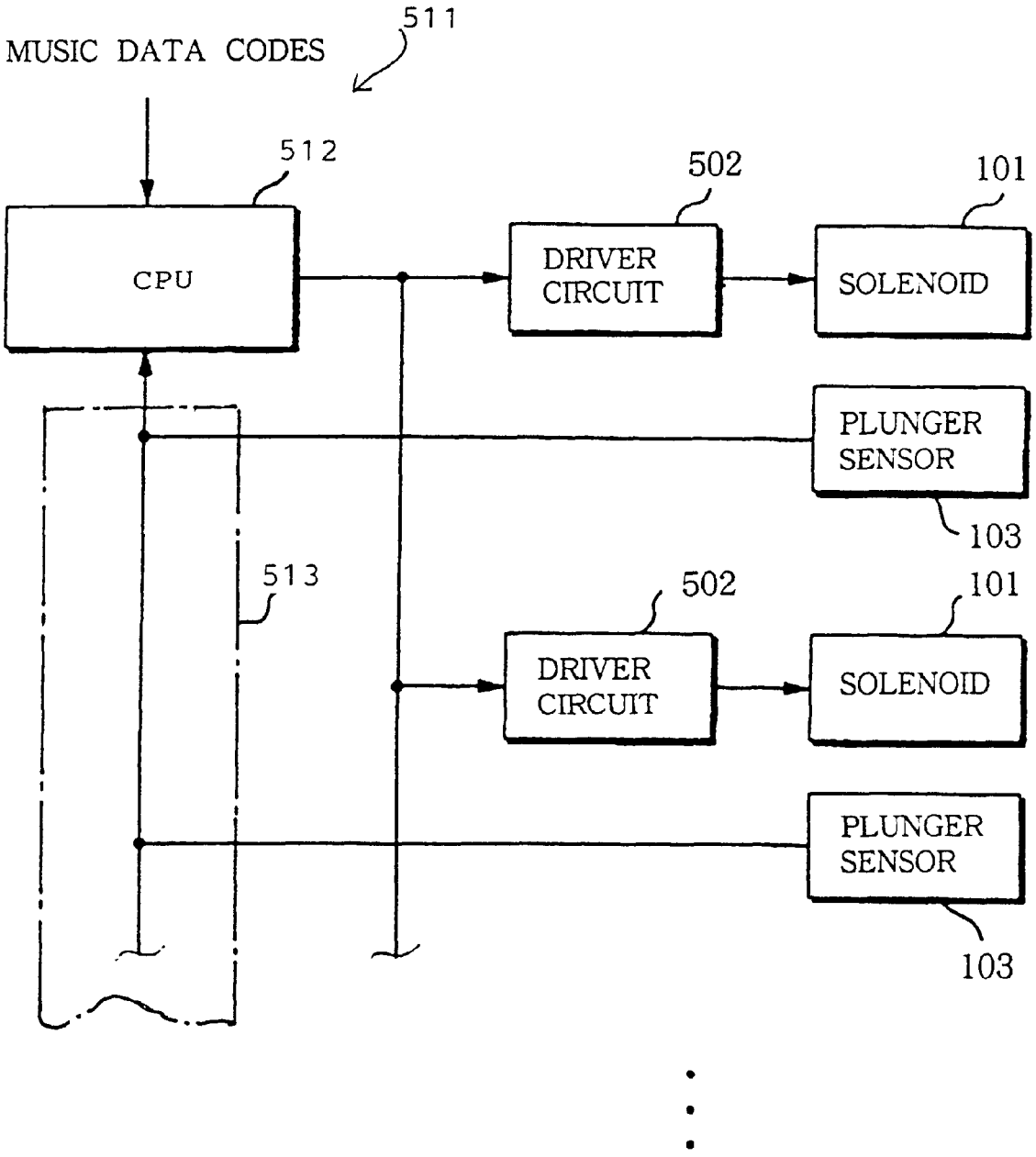
FIG. 6 is a block diagram showing the electric arrangement of an automatic player incorporated in the automatic player piano.

FIG. 6 shows the circuit arrangement of the automatic player 7. As described hereinbefore, the electric circuit 109 is integrated on the rigid circuit board fixed to the frame 300. The electric circuit 109 includes driver circuits 502. The driver circuits 502 are respectively associated with the plunger sensors 31, and are connected to the solenoids 101. The controller 501 sequentially produces the control signals on the basis of the set of music data codes, and supplies the control signals to the driver circuits 502. The driver circuits 502 tailor the driving signals on the basis of the control signals, and supply the driving signals to the associated solenoids 101.

On the other hand, the plunger sensors 103 are connected through the connectors 108 to the multiplexer 513, which in turn is connected through an analog-to-digital converter (not shown) to the central processing unit 512. The multiplexer 513 is responsive to a multi-bit control signal representative of the plungers to be connected to the central processing unit 512, and selectively connects the signal terminals S1 of the connectors 108 to the data processing unit 512 through the analog-to-digital converter. The central processing unit 512 sequentially changes the bit pattern of the multi-bit control signal so as to periodically scan the plunger sensors 103 for the current plunger positions. Thus, the central processing unit 512 periodically checks the digital feedback signals to see whether or not the driver circuits 502 moves the plungers 102 along the target trajectories. If a plunger 102 swerves from the target trajectory, the data processing system 511 instructs the associated driver circuit 502 to change the magnitude of the driving signal, and forces the plunger 102 to move on the target trajectory.

Figure 7:
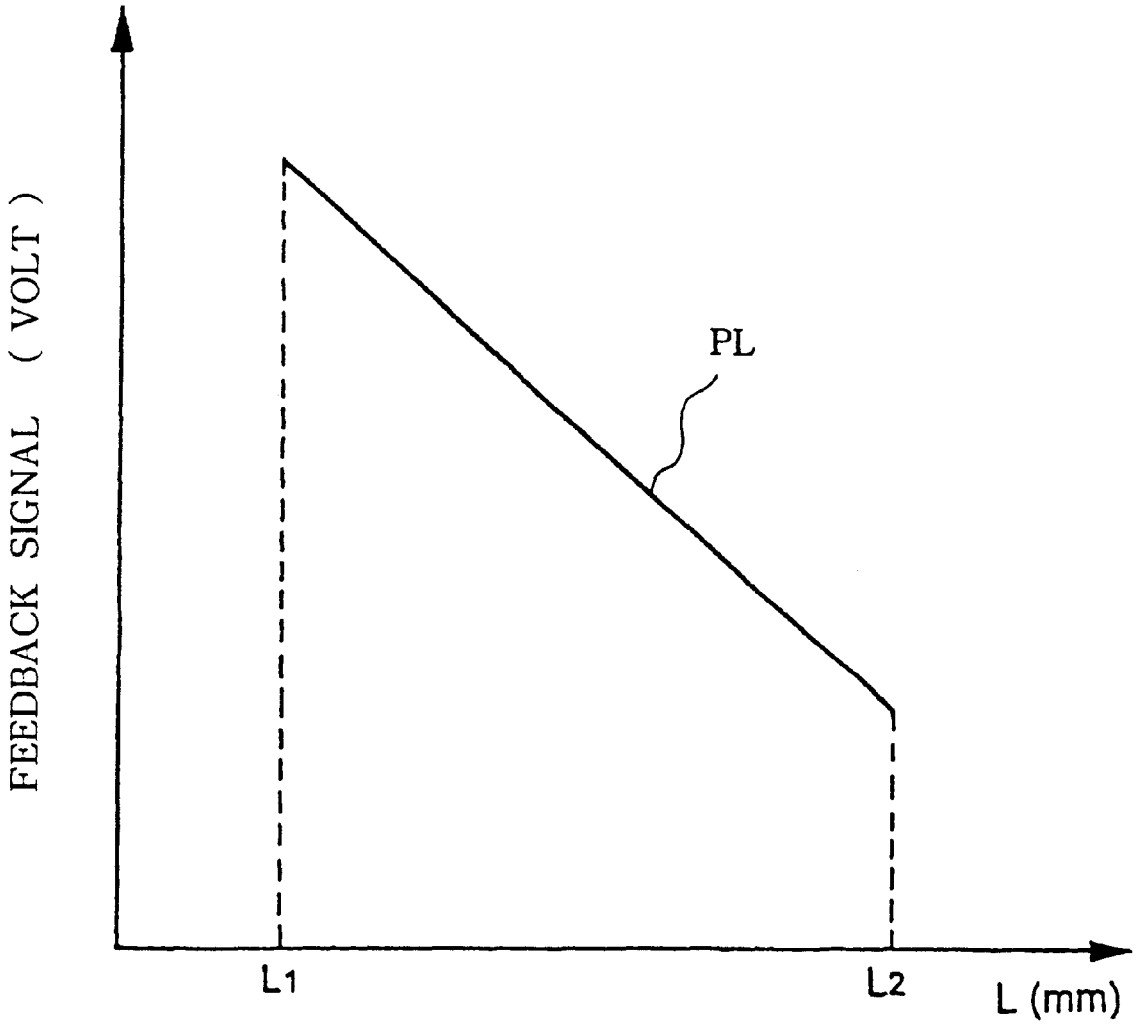
FIG. 7 is a graph showing a relation between the position of a plunger and an analog feedback signal.
Figure 8:
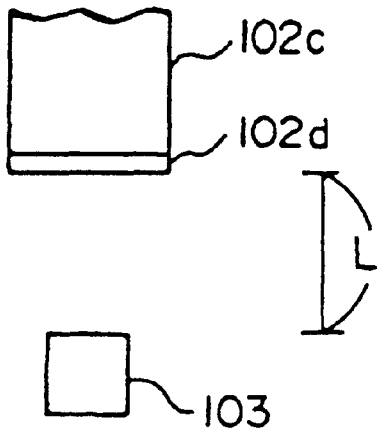
FIG. 8 is a view showing the relative position between a set of light emitting element light-detecting element and a reflector attached to the plunger.

FIG. 7 shows a relation between the plunger position and the magnitude of the feedback signal. The reflecting plate 102*d* is attached to the bottom surface of the body of the plunger 102*c*, and the set of light-emitting element/light-detecting element is opposed to the reflecting plate 102*d* as shown in FIG. 8. While the plunger 102 is resting in the lowest position, the reflecting plate 102*d* is spaced from the set of light-emitting element/light-detecting element 103 by L1. When the solenoid 101 is energized with the driving signal, the plunger 102 projects toward the associated black/white key 10, and the distance is increased from L1 to L2. While the plunger 102 is projecting toward the associated black/white key 10, the light-detecting element 103*b* is decreasing the photo-current, and the magnitude of the feedback signal is substantially linearly decreased as indicated by plots PL. Thus, the plunger sensor 31 achieves the good linearity, and any ripple is not contained in the feedback signal. The linearity is important, because the data processing system 511 exactly retrieves the plots PL through the interpolation on the basis of the digital feedback signal representative of the discrete values of the analog feedback signal. The prior art controller requires a complicated calculation in the interpolation on the basis of the feedback signal from the prior art photo-transmission type plunger sensor 3/4 due to poor linearity of the feedback signal. When the automatic player is powered, the data processing system 511 scans the plunger sensors 31 for the feedback signals at the home positions, and stores the initial values of the digital feedback signals in the random access memory. The central processing unit 512 determines the actual trajectories on the basis of the differences from the initial values. Even if the relative position between the reflecting plate 102*d* and the set of light-emitting element/light-detecting element 103 is unintentionally changed, the change does not have any influence on the current plunger position, and, accordingly, the data processing system 511 determines the actual trajectories of the plungers at all times. In other words, the aged deterioration does not influence the plunger sensors 31 according to the present invention. Thus, the plunger sensor 31 according to the present invention is free from the problems inherent in the prior art photo-transmission type plunger sensor 3/4.

The plunger sensors 31 are further free from the problems inherent in the prior art plunger sensor of the type having the coil and the magnet. The plunger velocity does not have any influence on neither the current plunger position nor the differentiation. This means that the data processing system 511 exactly determines the plunger velocity on the basis of the variation of the current plunger position.

The automatic player piano according to the present invention generates the piano tones in both acoustic playing and automatic playing modes as follows. While a pianist is playing a tune on the keyboard 8 in the acoustic playing mode, the hammers are driven for rotation by the actions linked with the depressed black/white keys 10, and strike the associated sets of strings for generating the piano tones along the tune. Thus, the automatic player piano behaves in the acoustic playing mode as similar to a standard acoustic piano.

The automatic player 7 plays a tune on the keyboard 8 without fingering in the automatic playing mode. When the automatic player is powered, the controller 501 firstly initializes the registers and the random access memory, and, thereafter, scans the plunger sensors 103 for the initial values. The initial values are representative of the distances between the reflecting plates 102*d* and the sets of light-emitting element/light-detecting element without any driving current on the solenoids 101, and the controller 501 stores the initial values in the random access memory.

The disk driver transfers the music data codes from the compact disk or the floppy disk to the random access memory, and the music data codes are processed in the order of key events to be occurred. Assuming now that a black/white key is to be depressed and, thereafter, released, a music data code representative of the key-on event is processed so as to produce the target trajectory and the control data representative of the magnitude of the driving signal. The data processing system 511 supplies the control signals to the driver circuit 502 associated with the black/white key, and the driver circuit 502 produces the driving signal on the basis of the control signal. When the driver circuit 502 energizes the solenoid 101 with the driving signal, a magnetic field is created around the solenoid 101, and the yoke 100 offers the magnetic path. Magnetic force is exerted on the plunger 102 in the magnetic field, and the plunger 102 upwardly projects from the solenoid 101. While the plunger is being upwardly moved, the distance between the reflecting plate 102*d* and the set of light-emitting element/light-detecting element 103 is gradually increased.

The data processing system 511 periodically requests the multiplexer 513 to transfer the feedback signal from the associated plunger sensor 103 to the analog-to-digital converter incorporated in the data processing system 511. The data processing system 511 interpolates the digital data codes representative of the discrete values of the feedback signal, and determines part of the actual trajectory of the plunger 102. The data processing system 511 compares the part of the actual trajectory with the corresponding part of the target trajectory to see whether or not the plunger is moving on the target trajectory. When the answer is affirmative, the data processing system 511 does not change the control data. However, if the plunger 102 swerves from the target trajectory, the data processing system 511 instructs the driver circuit 502 to change the driving signal through the control signal. The amount of current passing through the solenoid 101 is varied, and the magnetic force is regulated. The data processing system 511 periodically repeats the above-described feedback control so that the plunger 102 exactly traces along the target trajectory. The plunger 102 exerts the force equal to that in the original performance on the associated black/white key 10, and moves the rear end portion of the black/white key 10 upwardly. The associated action is actuated, and the hammer is driven for rotation. Finally, the set of strings is struck by the hammer, and generates the piano tone.

The driver circuit 502 continuously applies the driving signal to the solenoid 101, and the plunger 102 keeps the black/white key 10 depressed. When the music data code representative of the key-off event is processed, the data processing system 511 determines a target backward trajectory, and produces the control signal. The data processing system 511 supplies the control signal to the driver circuit 502, and the driver circuit 502 changes the driving signal. The driving current is gradually decreased, and the plunger 102 is retracted into the solenoid 101. While the plunger 102 is being retracted, the plunger sensor 103 periodically reports the current plunger position to the controller 501, and the driver circuit 502 regulates the driving signal through the feedback control. The black/white key 10 returns to the rest position along the backward target trajectory, and the associated damper mechanism decays the piano tone at the timing same as the timing in the original performance. As a result, the automatic player 6 reproduces the piano tone, which is identical in the loudness and the length with the original tone. This means that the automatic player faithfully reproduces the original performance.

In the above-described embodiment, the black/white keys 10 serve as manipulators, and the disk controller 501, the data processing system 511 and the electric circuit 109 as a whole constitute a controlling system.

As will be appreciated from the foregoing description, the plunger sensor 31 according to the present invention is compact so as to be installed under the keyboard 8. Moreover, the plunger sensor 31 is free from the noise and the aged deterioration. This results in that the plunger sensor 31 produces a signal exactly representing the current plunger position. Accordingly, the automatic player 7 equipped with the plunger sensors 31 faithfully reproduce the tones along a tune.

Although a particular embodiment of the present invention has been shown and described, it will be apparent to those skilled in the art that various changes and modifications may be made without departing from the spirit and scope of the present invention.

For example, the reflector may be attached to the lower surface of the plunger head 102*c*. The bottom surface of the body 102*a* may be subjected to the surface treatment so as to serve as the reflector 102*d*.

The automatic player piano according to the present invention may further have a recording mode for producing a set of music data codes representative of a performance on the keyboard 8. The damper is brought into contact with the sets of strings at the timing same as that in the original performance, and the vibrations of the set of strings are decayed.

Thus, the solenoid-operated key actuators 30 exactly move the associated black/white keys as similar to those in the original performance by virtue of the plunger sensors 31. This results in that the automatic player faithfully reproduces the original performance without fingering on the keyboard 8.

A silent system may be further incorporated in the automatic player piano according to the present invention. The silent system includes a hammer stopper changeable between a free position and a blocking position and an electronic sound generating system. When the hammer stopper is changed to the free position, the hammer stopper permits a player to play a tune on the keyboards in the acoustic playing mode. When the hammer stopper is changed to the blocking position, the hammers rebounds thereon after the escape of the jacks and before striking the sets of strings, and electronic sound generating system radiates electronic tones corresponding to the acoustic tones from a sound system.

The set of music data codes may be supplied from a data source through a telecommunication cables.

Another plunger sensor may have a pair of connectors, which respectively have clamps at the leading ends for grasping the rigid board 104. The pair of connectors achieves the advantages same as the connectors 105*a*/105*b*.

In the above-described embodiment, the reflecting plate is movable with respect to the yoke 100 together with the plunger 102, and the plunger sensor 31 is stationary with respect to the yoke 100. In another embodiment, the plunger sensor 31 may be movable together with the plunger 102 in such a manner as to radiate a light beam toward the stationary reflecting plate 102*d*.

The plunger sensor 31 may be applied to another apparatus for detecting the current plunger position of the solenoid-operated actuator. The apparatus may be another kind of musical instrument. However, the apparatus is not limited to a musical instrument.

What is claimed is:

1. A plunger sensor associated with a solenoid-operated actuator, comprising:

a reflecting means attached to one of a plunger of said solenoid-operated actuator and a member which is stationary with respect to a solenoid of said solenoid-operated actuator;

a photo-coupler attached to the other of said plunger and said member and radiating a light beam toward said reflecting means and producing a signal representative of a position of said plunger position as a function of a reflection returning from said reflecting means.

2. The plunger sensor as set forth in claim 1, in which said reflecting means is attached to an end surface of said plunger opposite to another end surface of said plunger for pushing an associated manipulator, and said member is connected to said solenoid.

3. The plunger sensor as set forth in claim 2, in which said plunger sensor further includes mechanical connectors integral with a bobbin of said solenoid and projecting from said bobbin, said member being supported by means of said mechanical connectors.

4. The plunger sensor as set forth in claim 3, in which said plunger sensor further includes an electrical connector connected between conductive cables of a controlling system and said photo-coupler and having terminals assigned to power voltages and another terminal assigned to said one of said detecting signals.

5. The plunger sensor as set forth in claim 3, in which said mechanical connectors are resiliently deformable, and have respective stem portions projecting from said bobbin and respective wedges formed at leading ends of said stem portions and passing through holes formed in said member so as to resiliently press said stem portions against the inner surfaces of said holes.

6. The plunger sensor as set forth in claim 2, in which said reflecting means is a reflecting plate having a reflecting surface opposed to said photo-coupler.

7. The plunger sensor as set forth in claim 6, in which said reflecting surface is subjected to a surface treatment before being attached to said plunger.

8. The plunger sensor as set forth in claim 7, in which said surface treatment is selected from the group consisting of a blasting and a frosting.

* * * * *